US008308243B2

(12) United States Patent
Stoffer

(10) Patent No.: US 8,308,243 B2
(45) **Date of Patent: *Nov. 13, 2012**

(54) ACCESSORY FOR AIDING THOSE WORKING ON THEIR MOTOR SKILLS

(76) Inventor: Jan Renee Stoffer, Centennial, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/374,853

(22) Filed: Jan. 19, 2012

(65) Prior Publication Data

US 2012/0161492 A1 Jun. 28, 2012

Related U.S. Application Data

(63) Continuation of application No. 12/802,286, filed on Jun. 3, 2010, now Pat. No. 8,123,300, which is a continuation of application No. 11/430,407, filed on May 9, 2006, now abandoned.

(51) Int. Cl.
*A47C 16/02* (2006.01)

(52) U.S. Cl. ..... 297/423.39; 297/423.4; 248/188.8; 248/346.01; 248/916; 5/507.1; 5/658; 108/106; 108/107; 108/110

(58) Field of Classification Search ..... 297/423.39, 297/423.4, 248; 248/188.8, 210, 235, 238, 248/346.01, 346.05, 916; 5/503.1, 507.1, 5/658; 108/106, 107, 110, 147.12, 147.13, 108/147.14, 147.15, 147.18
See application file for complete search history.

(56) References Cited

U.S. PATENT DOCUMENTS

| | | | | | |
|---|---|---|---|---|---|
| 231,529 | A | * | 8/1880 | Boyington | 297/423.4 X |
| 388,981 | A | * | 9/1888 | La Barbe | 297/423.4 X |
| 1,344,540 | A | * | 6/1920 | Kirchner | 49/464 |
| 2,664,150 | A | * | 12/1953 | Byrne | 297/466 |
| 2,826,246 | A | * | 3/1958 | Adams et al. | 297/466 |
| 2,850,080 | A | * | 9/1958 | Meaney | 297/248 X |
| 2,888,976 | A | * | 6/1959 | Hart | 297/256.11 |
| 2,986,437 | A | * | 5/1961 | Davis | 297/423.4 X |
| 3,311,410 | A | * | 3/1967 | Hill | 297/423.4 |
| 3,448,949 | A | * | 6/1969 | Kelley | 267/140.3 |
| 3,531,071 | A | * | 9/1970 | Kubli | 248/68.1 |
| 3,709,326 | A | * | 1/1973 | Habgood, Jr. | 206/386 |
| 3,913,976 | A | * | 10/1975 | Plancher et al. | 297/344.18 |
| 4,341,421 | A | * | 7/1982 | Rowley | 297/465 |
| 4,744,602 | A | * | 5/1988 | Campbell et al. | 297/423.4 X |
| 4,805,938 | A | * | 2/1989 | Redmond et al. | 297/248 X |
| 5,141,286 | A | * | 8/1992 | Ayala et al. | 297/423.4 |
| 5,207,481 | A | * | 5/1993 | Ayala et al. | 297/423.4 X |
| 5,333,825 | A | * | 8/1994 | Christensen | 248/346.03 X |
| D371,462 | S | * | 7/1996 | Grossmith | D6/349 |
| 5,833,206 | A | * | 11/1998 | Peacock | 248/188.5 X |

(Continued)

*Primary Examiner* — Rodney B White

(74) *Attorney, Agent, or Firm* — John H. Miller

(57) ABSTRACT

An accessory for a chair having two or more front legs, for use in cooperation with at least one of the front legs of the chair and for providing a good platform for a person's foot or feet while sitting in the chair working on motor skills, the accessory comprising one or more board items comprising one or more board-like items, including planks, of various thicknesses having on or in each item at least one restraining device having one or more chair-leg contacting surfaces that will prevent a child, while sitting in the chair, from moving the board-like item out of its functional place with his feet. The chair accessory is used with a chair including a child's chair to provide a foot rest when the chair occupant's legs are too short to allow the occupant's feet to reach the floor to provide stability necessary to permit more advanced fine motor development.

21 Claims, 3 Drawing Sheets

U.S. PATENT DOCUMENTS 6,132,002 A * 10/2000 Brown, II ..... 297/423.4 X
6,413,086 B1 * 7/2002 Womack ..... 433/72
6,676,213 B1 * 1/2004 Dlugos ..... 297/256.11
6,733,367 B1 * 5/2004 Nguyen ..... 451/29
6,892,991 B1 * 5/2005 Soh ..... 248/188.2
7,681,847 B2 * 3/2010 Levin ..... 248/346.01 X
8,123,300 B2 * 2/2012 Stoffer ..... 297/423.39
8,136,885 B2 * 3/2012 Perlstein ..... 297/423.4 X
2004/0041453 A1 * 3/2004 Ellis et al. ..... 297/344.18
2004/0178301 A1 * 9/2004 Wampler et al. ..... 242/603
2006/0185281 A1 * 8/2006 Lynch et al. ..... 52/311.2
2008/0020917 A1 * 1/2008 Pohlmann ..... 493/395
2008/0217981 A1 * 9/2008 Ton-That ..... 297/423.4
2010/0060068 A1 * 3/2010 Perlstein ..... 297/423.4

* cited by examiner

ACCESSORY FOR AIDING THOSE WORKING ON THEIR MOTOR SKILLS

This application is a continuation of patent application Ser. No. 12/802,286, filed Jun. 3, 2010, now U.S. Pat. No. 8,123,300 issued Feb. 28, 2012, which application was a continuation of patent application Ser. No. 11/430,407, filed May 9, 2006, now abandoned. This invention involves an accessory for a chair and more particularly an accessory that accommodates the length of different peoples' legs, and provides a good platform for peoples' feet to rest on a relatively firm surface while sitting in a chair using their motor skills

BACKGROUND

Children's chairs are used in various places, but mostly in various kinds of schools, day care centers and libraries. Children's chairs come in only a few sizes and as a result, often the children's feet don't reach the floor when sitting in a child's chair, an undesirable handicap for children using or working on their motor skills while sitting in the chair and particularly for handicapped children. Chairs with adjustable legs are known, as evidenced by Published U.S. Patent Application 20040041453, but such chairs are complex and more expensive and therefore are not readily available. Almost all of the child's chairs in existence are of a non-adjustable kind.

Footstools and items like books can be used, but are expensive or the wrong height and in any case quickly get moved out of a useful location by the child. Similar needs exist in rehabilitation centers, nursing homes, etc. for both children and adults. What has long been needed, and is satisfied by the invention, is a simple, relatively inexpensive, easy to use product to satisfy this long felt need and that is provided by the invention disclosed herein.

SUMMARY

The invention comprises one or more board-like items including plank items of various thicknesses having on or in each item at least one device having one or more chair-leg contacting surfaces that will prevent a child, while sitting in the chair, from moving the board-like item out of its functional place with his feet. The board-like item can be like a plank or can be of any reasonable shape like a semicircle shaped, oval shaped, diamond shaped, or other shapes. For purposes of illustration of the invention in the figures, plank shapes are used. The restraining devices can have one or more chair-leg contacting surfaces that can include one or more openings in end portions of the plank item such as a hole, of any reasonable shape, or a slot of various shapes in one or both end portions of the plank item, or can be at least one device that is attached to an end portion the board-like item, or still further, can be a clamp that slips over a chair leg or attaches to the leg and clamps onto the board-like item, multiples of these or any combination thereof.

The board-like item restraining device mentioned above can be of any kind that when attached to the board-like item either attaches to the chair leg or surrounds enough of the chair leg that a portion of the fixture will contact the chair leg and prevent movement of the board-like item out of its functional location when the child attempts to move the board-like item out of place. More typically, one of the above-described devices will be located in, on or near each end or end portion of the board-like plank. By "end portion of the board-like item" is meant a portion at the end of a board-like item and having enough length to make or install the restraining device, usually no more than about one-third the length of the board-like item and more typically no more than one-quarter the length of the board-like item and it can be as little as about one-quarter inch.

The legs of a child's chair are spaced apart a distance that is typically in the range of about 10-16 inches and this spacing will normally increase for an adolescent to an adult chair to a spacing of up to about 36 inches. It is most desired to have the board-like item or plank contact the front legs of the chair to restrain the plank, but it is also possible to construct the invention to contact one or both of the back legs of the chair, with or without contacting one or both front legs of the chair, but to do so is an inefficient use of material and adds to the weight of the plank.

Two or more planks can be used together, one on top of the other, to provide a footrest of proper height. It is often desirable to use a cushioning material or elastomeric material on the chair leg-contacting surface of the devices so minimal noise will be caused when the child moves the board-like item to cause the chair leg contacting surfaces to strike the chair legs.

The board-like items, including planks, when in operating position either have their bottom surfaces resting on the floor or on the top surface of another board-like item. The board-like restraining devices need not contact the chair legs except when the person sitting in the chair moves the board-like item sufficiently to bring a surface of the restraining device into contact with one or more chair legs. The restraining device can also clamp to a chair leg if desired by using appropriate clamps that are conventional at the time of use, including spring loaded clamps, bolt adjustable clamps, compressible material biased clamps and equivalent clamps.

To use the invention, one or more of the board-like items are affixed to the front chair legs, often simply by lifting the front of the chair and setting the front legs into the devices including openings in the board-like items, or in the fixtures, or by moving the fixtures so that a part of each fixture surrounds a portion of a front leg. On embodiments wherein the fixtures are attached to the front legs of the chair, it is merely necessary to slip each end of the board-like item into a clamp or other plank holding member on the fixture including a jigsaw-puzzle type fixture.

When the word "about" is used herein it is meant that the amount or condition it modifies can vary some beyond that stated so long as the advantages of the invention are realized. Practically, there is rarely the time or resources available to very precisely determine the limits of all the parameters of ones invention because to so do would require an effort far greater than can be justified at the time the invention is being developed to a commercial reality. The skilled artisan understands this and expects that the disclosed results of the invention might extend, at least somewhat, beyond one or more of the limits disclosed. Later, having the benefit of the inventors disclosure and understanding the inventive concept, the objectives of the invention and embodiments disclosed, including the best mode known to the inventor, the inventor and others can, without inventive effort, explore beyond the limits disclosed using only ordinary skill to determine if the invention is realized beyond those limits, and when embodiments are found to be without any unexpected characteristics, those embodiments are within the meaning of term about as used herein. It is not difficult for the artisan or others to determine whether such an embodiment is either as expected or, because of either a break in the continuity of results or one or more features that are significantly better than reported by the inventor, is surprising and thus an unobvious teaching leading to a further advance in the art.

DETAILED DESCRIPTION OF SOME EMBODIMENTS

Figure 1:
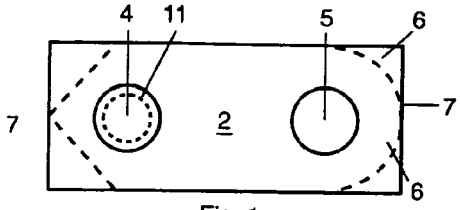
FIG. 1 is a plan view of one embodiment of the invention and also showing several optional modifications.

FIG. 1 shows a partial plan view of one embodiment of the invention for use with a chair, and some optional modifications. This basic embodiment is a board-like item such as a plank 2 having a thickness in the range of about ⅛.sup.th inch to about 4 inches or more, and having an opening 4,5 through, each end portion of the plank 2 near each end of the plank, in this embodiment a round hole 4,5. A typical plank 2 has a thickness of ¼ inch, or increments thereof including ½, ¾, 1, 1.5, 2, 3 and 4 inches or more thick or any intermediate thickness between these examples.

The plank 2 has a length long enough to place the openings 4,5 at the location of the front legs of the chair on which the invention is being used. A greater length can be used but it is only a waste of material without adding any offsetting benefit. In other embodiments that will be described later, the plank 2 can be shorter than the distance between the front legs of the chair. The corners 6 of the ends 7 of the plank can be square, tapered, or radiused as shown by the dotted lines in FIG. 1, the radiused ends being more costly, but also more child friendly. The shape of the openings 4,5 can be round as shown, or square, oval or of any shape so long each opening 4,5 will accommodate the bottom portion of a front leg of the chair. The openings 4,5 are spaced apart to match up with the front legs of the child chairs that the invention will be used on.

Figure 1A:
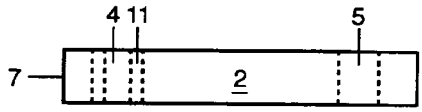
FIG. 1A is a partial front view of the embodiment(s) shown in FIG. 1.
Figure 1C:
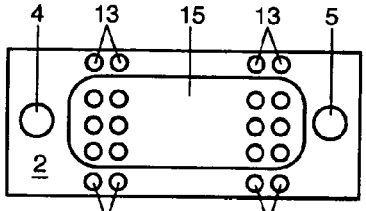
FIG. 1C is a plan view of a modification of the embodiment shown in FIG. 1.
Figure 1D:
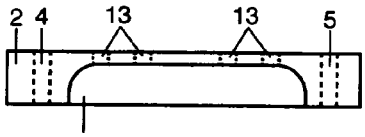
FIG. 1D is a front view of the embodiment shown in FIG. 1C.
Figure 1B:
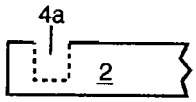
FIG. 1B is a partial front view of a another embodiment, and also shown in FIG. 1.

As shown in FIG. 1A, the openings 4,5 can be optionally lined with an elastomer or most any cushiony material including a layer 11, usually thin to economize, of foam, nonwoven material, quilted material, and the like to dampen noise. As shown in FIG. 1B, the openings 4,5 need not extend entirely through the thickness of the plank 2, particularly when the thickness of the plank 2 is about ¼ inch or thicker, but can be a hole 4*a*, 5*a* (not shown) on the opposite end portion, extending part way through the plank 2. As shown in FIGS. 1C, 1D and 1E, the plank 2 can also have one or a plurality of holes 13, or one or more depressions 15, or one or more voids 17, all to reduce the weight of the plank 2 and to minimize the amount of material required. The planks 2 can be configured in any combination of these variations in any of the embodiments of the invention to save costs, and/or in many instances to reduce weight, or merely as a matter of preference.

Figure 1F:
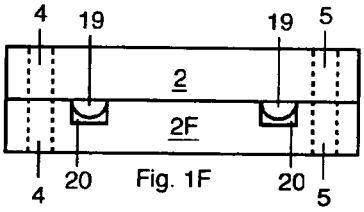
FIG. 1F is a front view of still another modification of the embodiment shown in FIG. 1 and showing a stacked arrangement.
Figure 1E:
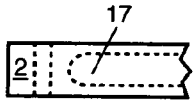
FIG. 1E is a partial front view of still another modification and embodiment similar to, but different than the embodiment shown in FIG. 1D.
Figure 1G:
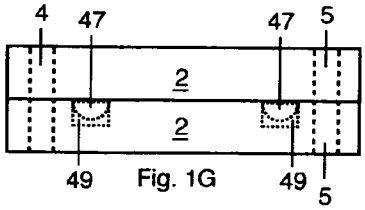
FIG. 1G is a front view of still another embodiment, a modification of the embodiment shown in FIG. 1F.

Two or more planks 2 of the same or different thicknesses can be stacked, as shown in FIGS. 1F, 1G, 9 and 9A, to achieve the proper height. As shown in FIG. 1F, the plank 2 can have one or more projections 19 on at least one of the major surfaces that align with depressions 20 in a major surface of another plank 2F so that when two or more planks 2, 2F, etc. are stacked on one another, the projections 19 fitting into the depressions 20 tend to keep the planks 2 and 2F from sliding apart. The projections 19 can be ridges and the depressions 20 can be troughs as shown, but they can be any shape so long as the projections and depressions are compatible to nest together, e.g. dimple shaped projections can be used with troughs, but better with mirror image depressions of the dimples. On chairs having front legs 3 that taper towards the back of the chair, each additional plank 2 may be offset a small distance from the plank 2 beneath it, but the width of the planks 2 are sufficient to make sure that will not affect the child sitting in the chair. The width of the planks 2, distance from front to back, can be any reasonable desired width and are usually from about 4 inches to about 12 inches wide. Greater widths can be used, but it is a waste of material because it is unnecessary. While the openings 4,5 shown in FIGS. 1, 1C, 2, 3 and 9A are generally in the center, front to back, they need not be and actually will most often be offset, such as shown in FIG. 3B. By offsetting the openings in the plank 2 for the front legs of the chair towards the rear of the chair, more of the plank 2 is in the location needed for the children's feet.

Figure 2:
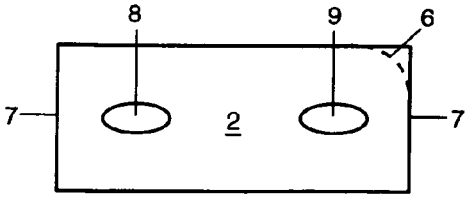
FIG. 2 is a plan view of another embodiment of the invention.
Figure 2A:
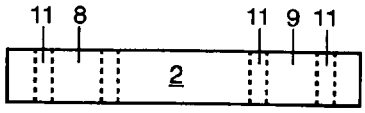
FIG. 2A is a front view of the embodiment shown in FIG. 2.

On some chairs the front legs taper toward the center and may also taper towards the back of the chair as one moves up the legs. To accommodate this type of chair, when the devices are openings, they can be larger than needed for the size of the leg and/or can be oval, see openings 8,9 in FIGS. 2 and 2A, to accommodate different spacings between the front legs of the chair, at different heights, of the front legs, above the bottom of the legs. This allows the planks 2 to be stacked to match the need of the child that will be sitting in the chair. The openings 4,5 or 8,9, etc. can be lined with a layer of sound absorbing, soft or cushiony material 11 to prevent or reduce noise should the child move the plank 2 back and forth with their feet to strike the front leg(s) of the chair.

Figure 3:
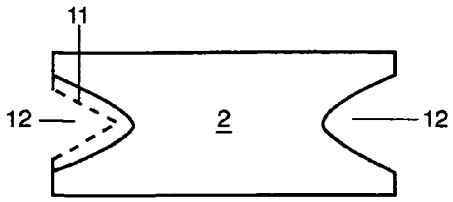
FIG. 3 is a plan view of still another embodiment of the invention.
Figure 3A:
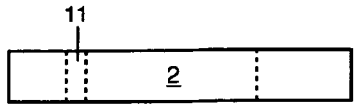
FIG. 3A is a front view of the embodiment shown in FIG. 3.
Figure 3B:
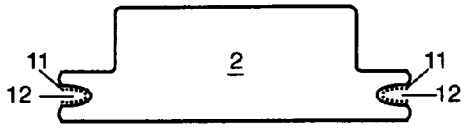
FIG. 3B is a plan view of an embodiment that is a modification of the embodiment shown in FIG. 3.

The device attached to, or part of, the plank and having a chair leg contacting surface, plank restraining device, can optionally be openings in the plank 2 that are open at one or two of the ends 7 as shown in FIGS. 3 and 3A. When used herein, the term "cut-out" means an opening at the ends of the plank 2 regardless of the shape of the opening(s). In this embodiment the openings 12,13 are V or U shaped, but can be other shapes that will restrain the plank in position between the chair legs including V shaped, square shaped, rectangular shaped, triangular shaped, etc. The embodiments shown by FIGS. 3 and 3A, and those having modified shapes of the openings, are thought to be the least costly to make and the easiest to use. FIG. 3B shows one of many most desirable shapes of the plank 2, and having U shaped "cut-outs" 12, optionally with a soft or resilient lining 11.

Figure 4:
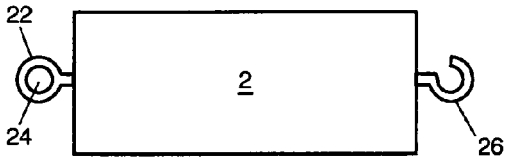
FIG. 4 is a plan view of other embodiments of the invention.
Figure 4A:
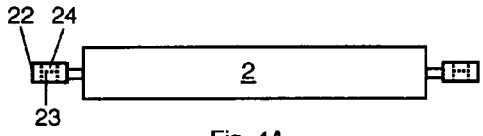
FIG. 4A is a front view of one of the embodiments shown in FIG. 4.

As shown in FIGS. 4-8A, the plank 2 need not have openings for contacting the front legs of the chair. Instead, a (board-like), plank restraining device can be attached to at least one end or end portion of the plank 2, more typically to each end or end portion, to keep the plank 2 in place at the chair. In FIG. 4 an eye bolt 22 can be attached, such as being screwed into the ends of the plank 2 with the opening 24 in the eye bolt 22 being large enough for a bottom portion of the chair's front legs to pass through. As shown in FIG. 4A, the opening 24, like the opening 4*a* in FIG. 1B, need not extend entirely through the eye bolt 22, see optional portion 23. As shown on the opposite end of the plank 2 in FIG. 4, the plank restraining device can also be various other configurations including a hook 26.

Figure 5:
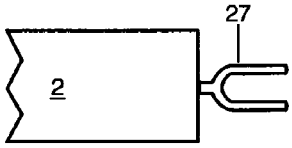
FIG. 5 is a partial plan view of still another embodiment of the invention.
Figure 6:
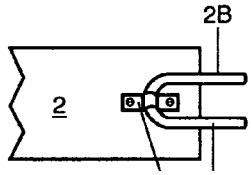
FIG. 6 is a partial plan view of yet another embodiment of the invention.

FIG. 5 shows a U shaped plank restraining device 27 like, or similar, to the tool holding devices readily in any hardware or building supply store. FIG. 6 shows an end of a plank 2 having a plank restraining device 28 attached to a major surface of an end portion of the plank 2. A bracket 29 of the plank restraining device 28 holds a U shaped plank restraining member 30 that can be pivoted at the bracket 28 to move the plank restraining member 30 into and out of a plank restraining position on a front chair leg. If desired, an appropriate portion of the major surface of the plank 2 opposite the major surface holding the plank restraining device 28 can be depressed or relieved to nest a similar or like plank restraining device 28 on a different plank 2 so that two or more planks 2, each having a leg restraining device 28 on each end portion, can be stacked securely for use or storage.

Figure 7:
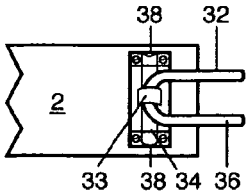
FIG. 7 is a partial plan view of still another embodiment of the invention.
Figure 7A:
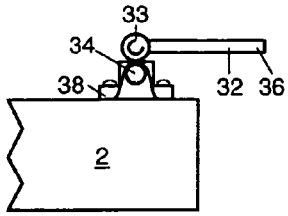
FIG. 7A is a partial front view of the embodiment shown in FIG. 7.
Figure 7B:
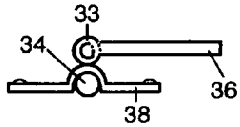
FIG. 7B is a front view of the device shown in FIG. 7A.

FIG. 7 shows a different plank restraining device 32 attached to a major surface of an end portion of the plank 2. A holder 33 of the plank restraining device 32, slidingly fastened to a rod 34, holds a U shaped plank restraining member 36, so it can be pivoted at the holder 33, that is attached by a spot weld or other means to a ring surrounding the rod 34, to move the plank restraining member 36 into and out of a plank restraining position on a front chair leg. The rod 34 is held in place at each end portion with a bracket 38 attached to an end portion of a major surface of the plank 2. Again, if desired, an appropriate portion of the major surface of the plank 2 opposite the major surface holding the plank restraining device 32 can be depressed or relieved to nest a similar or like plank restraining device 32 on a different plank 2 so that two or more planks 2, each having a leg restraining device 32 on each end portion, can be stacked.

Figure 8:
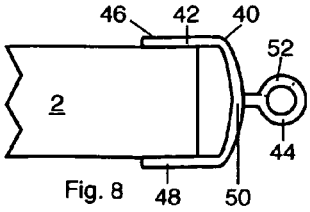
FIG. 8 is a partial plan view of still another embodiment of the invention.

FIG. 8 is a partial front view showing another embodiment of the invention. This embodiment comprises a plank 2 and a plank restraining device, a plank holder 40. The plank holder 40 comprises a spring clamp 42 to hold the plank 2 and a restraining member 44 attached in any suitable manner, or integral with, the clamp 42. The clamp 42 can be any type of clamp that will grip an end portion of the plank 2, spring gripping of the plank 2, pinned, screwed or otherwise attached to the plank 2. The spring clamp 42 illustrated is a U shaped metal or plastic device having an upper engaging member 46 and a lower engaging member 48 that are joined together with a biasing section 50 that biases the upper member 46 and the lower member 48 towards one another. This bias causes the engaging members 46,48 to grip two surfaces of end portion of the plank 2 after being forced apart to allow an end of the plank to be inserted into the clamp 42. The restraining member 44 can be shaped like, or similar to, the restraining members 26, 27, 28 and 36 shown in earlier embodiments. Shown in the embodiment of FIG. 8 is a hook 44, or with the optional portion 52, can be all or part of an eye bolt.

Figure 8A:
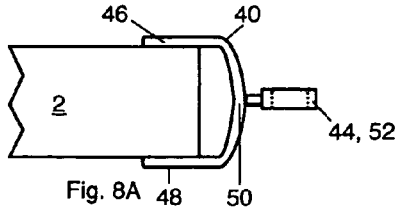
FIG. 8A is a partial front view of another embodiment that is a modification of the embodiment shown in FIG. 8.
Figure 9:
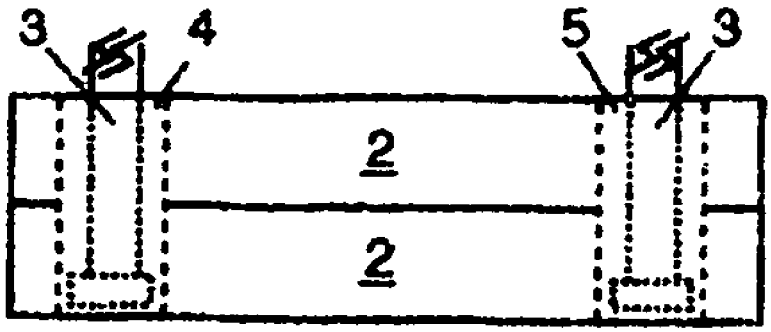
FIG. 9 is a front view of the embodiment of FIG. 1, but a stack of two in place on the front legs of a chair.
Figure 9A:
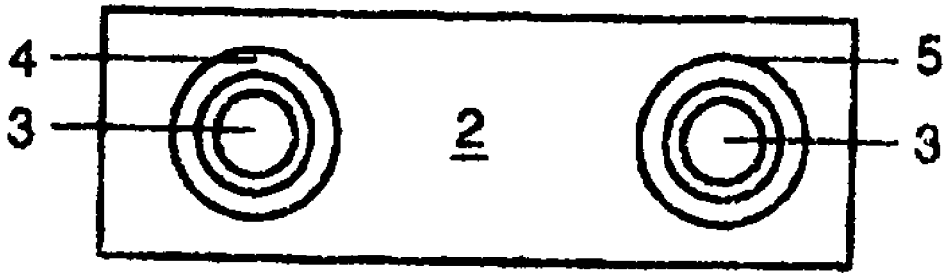
FIG. 9A is a plan view of the assembly shown in FIG. 9.

FIG. 8A shows a modification of the embodiment illustrated in FIG. 8, a spring clamp 40' comprised of similar parts, but sized to grip different surfaces of the end portions of plank 2, i.e. the major surfaces. The chair leg contacting portions of the plank restraining devices shown in FIGS. 4-8 can be can be coated with an elastomer or other cushioning material to reduce noise if desired.

Figure 10:
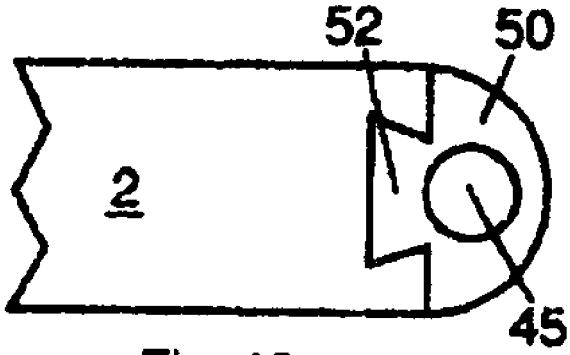
FIG. 10 is a partial plan view of still another embodiment of the invention wherein the fixture has a jigsaw-puzzle type, locking feature.

FIG. 10 shows another type of embodiment that can include many configurations. In this embodiment the plank 2 is shorter and one or both end portions of the plank 2 are configured to accept a mirror image configuration in a restraining device to form a locking arrangement much like a jigsaw puzzle. In this embodiment, FIG. 9, a restraining device 50 having a hole 45 for surrounding a leg of the chair and a configured end 52 for locking into the end portion of the board-like item, plank 2. The board-like item or plank restraining device 50 can attach to the chair leg in any suitable way including the many ways disclosed herein. Another kind of board-like item restraining device can be used on the other end of the plank 2 or the same kind as described above can be used.

The length of the board-like items, including the planks 2, can be up to a few inches, 3-6 or more longer than the distance between the front legs of the chair. They can be longer but to no good purpose and at a cost disadvantage. The length can be as little as about 6 inches or so, but more typically is from about 6-9 inches to about ¼-3 inches greater than the spacing between the far sides of the legs of the chair. The width, depth, of the plank 2 is typically about 6-12 inches. This width can extend the entire length, but need be this magnitude only in the area of where the feet will normally be such as +/− about 2-5 or 6 inches from the lengthwise centerline of the board-like item or plank. It is desirable that the plank extend behind the front edge of the front legs of the chair about 2-4 inches or so in the area where the feet will normally be to prevent children from getting the toes of their shoes caught on the back of the plank 2, but this is not essential to the invention. It is also desirable that the plank extend about 4-7 inches or more in front of the front of the front legs over either the entire length of the plank 2 or more typically about 2-5 or 6 inches on either side of the lengthwise centerline of the plank 2 to give the children a good platform for their feet. The thickness of the board-like items such as plank 2 is optional and typical dimensions are provided above. The thickness of the board-like item or plank 2 can vary over the area of the board-like item or plank 2. For example, the portions out of the normal reach of the feet can be thinner or thicker than the portion intended for foot contact.

The board-like items, including the planks 2, can be made from any suitable material including, but not limited to, all kinds of woods, wood products including particle board, chip board, OSB, plywood, etc., all kinds of plastics, solid and hollow, rigid and flexible foams with or without skins of the same or different material, laminates of any combination of materials named here, metals, stamped sheet metals or plastics, cork, ceramic tile, stone, composites of all types, paperboard, fibrous boards, etc. and equivalent products. It is desirable to paint or color the board-like items in conventional ways and also to optionally color code different thicknesses to aid those using the chair accessories of the invention. It is also to be understood that the invention includes board like items having one kind of plank restraining device disclosed, or equivalent, on one end of the board-like item while a different kind of plank restraining device is on the other end of the board-like item.

The invention has been described using a child's chair for illustration but it should be understood that the invention is applicable to all or most types of chairs. Many embodiments, options and modifications have been disclosed and it is to be understood that all reasonable combinations of these options and different embodiments and modifications are intended to be included in the invention described in the claims below. Different embodiments employing the concept and teachings of the invention will be apparent and obvious to those of ordinary skill in this art and these embodiments are likewise intended to be within the scope of the claims. The inventor does not intend to abandon any disclosed inventions that are reasonably disclosed but do not appear to be literally claimed below, but rather intends those embodiments to be included in the broad claims either literally or as equivalents to the embodiments that are literally included.

The invention claimed is:

1. An accessory for use with a chair having two or more front legs and for use in cooperation with the two or more front legs of the chair, the chair accessory comprising one or more board items, each board item having two ends, two end portions and a thickness of at least about ¼ inch and having on or in at least one of said two ends and/or in or on one or two of said two end portions of the board item a board item restraining device, each said board item restraining device, with another board item restraining device, functioning, in cooperation with lower portions of two of the front legs of the chair, to restrain the amount of the board item's horizontal movement in any horizontal direction with respect to the front legs of the chair such that each board item remains in a functional place on a floor, or on top of another board item, with a major portion of the board item being in front of the lower portion of the front legs of the chair for a foot or feet of a person sitting in the chair, each said board item having a bottom surface supported by either a floor or a top surface of another board item when in an operative position, an uppermost board item within the normal reach of the foot or the feet presenting a relatively firm, flat upper surface for one or two feet of the person sitting in the chair so that the person's foot or feet can rest on the relatively firm, flat surface enabling the person to work on their fine motor skills, wherein at least one of the board item restraining devices is selected from a group consisting of a depression, a hole, a slot, a hook, an eye bolt, an eye screw, a pivoting U shaped holder, a pivoting V shaped holder, a U shaped holder, a V shaped holder, an adjustable U shaped holder, an adjustable V shaped holder, a pivoting adjustable U shaped holder, a pivoting adjustable V shaped holder, a "cut-out" in one or more of the end portions of the one or more of the board items and any combination of these board item restraining devices.

2. The accessory of claim 1 wherein the board item is a plank having a thickness of at least ½ inch and wherein each board item restraining device is a plank restraining device and wherein the plank is adapted for use with a handicapped child, a child needing fine motor skills development or a person in rehabilitation.

3. The accessory of claim 2 wherein the plank restraining device is a "cut-out" in at least one end portion of the plank, said "cut-out" having an opening in one side of said "cut-out" to permit entry of one of the chair legs, the opening being aligned with one of the ends of said plank.

4. The accessory of claim 3 wherein the shape of the "cut-out" is selected from a group consisting of U shaped, V shaped, square shaped, rectangular shaped, half of a hexagon, and semi-circular shaped.

5. The accessory of claim 4 wherein the "cut-out" is through the entire thickness of the plank.

6. The accessory of claim 3 wherein the "cut-out" is through the entire thickness of the plank.

7. The accessory of claim 2 wherein the plank contains at least one of a hole, a depression, a trough, a dimple, or a void to either reduce the weight of the plank or to facilitate stacking of two or more planks or both and wherein the thickness of the plank is at least one-half inch thick.

8. The accessory of claim 1 wherein each board item restraining device comprises a depression, hole or slot in a major surface of at least one end portion of the board item.

9. The accessory of claim 8 wherein at least one depression is a hole that passes at least part way through the thickness of the board item and wherein the thickness of the board intern is at least ¾ inch thick.

10. The accessory of claim 9 wherein at least one of the holes is lined with a layer of a noise reducing material.

11. The accessory of claim 1 wherein at least one of the board item restraining devices is a "cut-out" in one end or one end portion of said board item.

12. The accessory of claim 11 wherein each board item restraining device is a "cut-out" and the shape of the "cut-out" is selected from a group consisting of U shaped, V shaped, square shaped, rectangular shaped, half of a hexagon, and semi-circular shaped, each of said "cut-out" shapes having an opening to permit entry of one of the chair legs to at least partially enter the opening, the opening being aligned with one of the ends of said board item.

13. The accessory of claim 12 wherein the "cut-out" is through the entire thickness of the board item.

14. The accessory of claim 11 wherein the "cut-out" is through the entire thickness of the board item.

15. The accessory of claim 1 wherein the shape of at least one of the "cut-outs" is selected from a group consisting of U shaped, V shaped, square shaped, rectangular shaped, half of a hexagon, and semi-circular shaped, each of said "cut-out" shapes having an opening to permit entry of the lower portion of one of the chair legs, the opening being aligned with one of the ends of said board item.

16. The accessory of claim 1 wherein the board item contains at least one of a hole, a depression, a trough, a dimple, or a void to either reduce the weight of the board item or to facilitate stacking of two or more board items or both.

17. The accessory of claim 1 wherein there are two plank item restraining devices, each being a depression in a major surface of an end portion of the plank, the two depressions being spaced apart to align with the bottoms of the front legs of the chair.

18. The accessory of claim 17 wherein at least one depression is a hole that passes at least part way through the thickness of the plank.

19. The accessory of claim 18 wherein at least one of the holes is lined with a layer of a noise reducing material.

20. An accessory for a chair having two or more front legs for use in cooperation with at least one of the front legs of the chair, the accessory comprising one or more board items, each having two ends, two end portions and a thickness of at least about ½ inch and having at each end or on each end portion of said board item a board item restraining device, each board item restraining device at least partially surrounding at least a lower portion of one of the front legs of the chair and functioning, in cooperation with lower portions of the front legs of the chair, with another board item restraining device, to restrain the amount of said board item's horizontal movement in any horizontal direction with respect to the front legs of the chair such that each board item remains in a functional place with a major portion of the board item being in front of the front legs of the chair for a foot or feet of a person sitting in the chair, each said board item having a bottom surface supported by either a floor or on another board item when in operating position, one board item supported by the floor and an uppermost board item presenting, within the normal reach of the foot or the feet, a relatively firm, flat upper surface for one or two feet of the person sitting in the chair so that the person's foot or feet can rest on the relatively firm, flat surface enabling the person to work on their fine motor skills, wherein at least one of the board item restraining devices is a "cut-out" in one end or one end portion of said board item.

21. An accessory for use with a chair having two or more front legs and for use in cooperation with the two or more front legs of the chair, the chair accessory comprising one or more board items, each board item having two ends, two end portions and a thickness of at least about ¼ inch and having on or in at least one of said two ends and/or in or on one or two of said two end portions of the board item a board item restraining device, each said board item restraining device, with another board item restraining device, functioning, in cooperation with lower portions of two of the front legs of the chair, to restrain the amount of the board item's horizontal movement in any horizontal direction with respect to the front legs of the chair such that each board item remains in a functional place on a floor with a major portion of the board item, being in front of the lower portion of the front legs of the chair, or on top of another board item, for a foot or feet of a person sitting in the chair, each said board item having a bottom surface supported by either a floor or on another board item when in an operative position, one board item supported by the floor or another board item, an uppermost board item presenting, within the normal reach of the foot or the feet, a flat upper surface for one or two feet of the person sitting in the chair so that the person's foot or feet can rest on the relatively firm, flat surface enabling the person to work on their fine motor skills, wherein at least one of the board item restraining devices is selected from a group consisting of a depression, a hole, a slot, a hook, an eye bolt, an eye screw, a pivoting U shaped holder, a pivoting V shaped holder, a U shaped holder, a V shaped holder, an adjustable U shaped holder, an adjustable V shaped holder, a pivoting adjustable U shaped holder, a pivoting adjustable V shaped holder, a "cut-out" in one or more of the end portions of one or more of the board items and any combination of these board item restraining devices and wherein the board item contains at least one of a hole, a depression, a trough, a dimple, or a void to either reduce the weight of the board item or to facilitate stacking of two or more board items or both.

* * * * *